US006000442A

United States Patent [19]

Busgen

[11] Patent Number: 6,000,442

[45] Date of Patent: Dec. 14, 1999

[54] WOVEN FABRIC HAVING A BULGING ZONE AND METHOD AND APPARATUS OF FORMING SAME

[76] Inventor: Alexander Busgen, Stahlstrasse 6, D-42281 Wuppertal, Germany

[21] Appl. No.: 08/930,844

[22] PCT Filed: Mar. 29, 1996

[86] PCT No.: PCT/EP96/01397

§ 371 Date: Dec. 15, 1997

§ 102(e) Date: Dec. 15, 1997

[87] PCT Pub. No.: WO96/31643

PCT Pub. Date: Oct. 10, 1996

[30] Foreign Application Priority Data

Apr. 6, 1995 [DE] Germany ..... 195 12 554
Oct. 31, 1995 [DE] Germany ..... 195 40 628

[51] Int. Cl.[6] ..... D03D 13/00; D03D 41/00; D03D 25/00

[52] U.S. Cl. ..... 139/389; 139/DIG. 1; 139/11; 139/192; 139/100; 139/105; 139/390; 139/59; 428/35.2; 428/35.5; 428/36.1; 428/257; 280/728.1; 264/257

[58] Field of Search ..... 139/389, DIG. 1, 139/11, 192, 100, 105, 390, 416–418, 59; 428/35.2, 35.5, 36.1, 257; 280/728.1; 264/257; 450/156

[56] References Cited

U.S. PATENT DOCUMENTS

| | | | |
|---|---|---|---|
| 579,164 | 3/1897 | Mcauliffe | 139/418 |
| 2,655,950 | 10/1953 | Mills | 139/418 |
| 3,132,671 | 5/1964 | Koppelman et al. . | |
| 3,340,919 | 9/1967 | Holbrook | 139/389 |
| 3,360,014 | 12/1967 | Poisson et al. | 139/389 |
| 3,807,754 | 4/1974 | Rodenbach et al. | 280/743.1 |
| 4,848,412 | 7/1989 | Pittman et al. | 139/416 |
| 5,011,183 | 4/1991 | Thornton et al. | 280/743.1 |
| 5,131,434 | 7/1992 | Krummheuer et al. | 139/389 |
| 5,277,230 | 1/1994 | Sollars, Jr. | 139/389 |
| 5,277,966 | 1/1994 | Nakayama et al. | 428/225 |
| 5,336,538 | 8/1994 | Kitamura | 428/35.2 |
| 5,441,798 | 8/1995 | Nishimura et al. | 428/229 |
| 5,477,890 | 12/1995 | Krummheuer et al. | 139/291 R |
| 5,651,395 | 7/1997 | Graham et al. | 139/390 |
| 5,685,347 | 11/1997 | Graham et al. | 139/390 |
| 5,707,711 | 1/1998 | Kitamura | 428/139 |
| 5,713,598 | 2/1998 | Morita et al. | 280/743.1 |

FOREIGN PATENT DOCUMENTS

| | | | |
|---|---|---|---|
| 0 302 012 | 2/1989 | European Pat. Off. . | |
| 0 687 596 | 12/1995 | European Pat. Off. . | |
| 814429 | 6/1937 | France | 139/416 |
| 2 213 363 | 8/1974 | France . | |
| 2 307 064 | 11/1976 | France . | |
| 39 15 085 | 11/1990 | Germany . | |
| 41 37 082 | 5/1993 | Germany . | |
| 63-182446 | 7/1988 | Japan | 139/418 |
| 2 272 869 | 6/1994 | United Kingdom . | |

OTHER PUBLICATIONS

*International Trade Bulletin*, Gewebemusterung mit Fächerwebblättern—eine alte und wieder neu entdeckte Technik, Feb. 1993, pp. 61–66, untranslated.

*Deutsche Textiltechnik 13*, (1963) pp. 95–101, untranslated.

*Primary Examiner*—Andy Falik
*Attorney, Agent, or Firm*—Alston & Bird LLP

[57] ABSTRACT

A process and apparatus for weaving a fabric with a three dimensional bulging zone, which is formed by increasing the density of the crossing points of the warp and weft threads so as to naturally impart a bulging zone in the fabric. The density is changed by changing the number of threads and/or changing the weave pattern. The lengths of the warp threads can also be increased in the bulging zone. In a preferred embodiment, the threads include a material which is settable by thermal or chemical treatment, and such that upon being set a three dimensional rigid matrix is formed which includes the non-settable threads as a reinforcement. The apparatus for carrying out the process takes the form of a loom having the capability of individually drawing off selected lengths of the warp threads from a warp supply, and a jacquard head for forming the weaving sheds and which has a control for changing the number of threads woven and/or the weave pattern.

20 Claims, 15 Drawing Sheets

LINEN WEAVING

BODY WEAVING, $K\frac{1}{2}Z$

ATLAS WEAVING, $A\frac{1}{4}(2)$

LINEN WEAVING (1xSF, 1xKF)

INTERLOCK 5 (1.5xSF, 1.5xKF)

INTERLOCK 6 (2xSF, 2xKF)

WOVEN FABRIC HAVING A BULGING ZONE AND METHOD AND APPARATUS OF FORMING SAME

BACKGROUND OF THE INVENTION

The invention refers to a process for weaving a three-dimensionally formed fabric zone.

Such a process is known from DE- 39 15 085 A1. In this known process, the warp threads are drawn off at the selvage at different speeds. Thereby, the three-dimensionally bulging fabric zone is formed by increasing the distances between the weft threads, i.e.: reducing the number of the points of intersection. The 3D shape of these fabric zones is unstable and the fabric structure depends on the 3D shape.

Other processes for weaving three-dimensional shells of fabric operate by varying the distances between the warp threads (U.S. Pat. No. 3,132,671; EP 0302012 A1).

These known processes are based on the principle to achieve the bulging of the fabric zone by increasing the distances between the threads, i. e.: by reducing the number of points of intersection per unit area. Therefore, the three-dimensionally bulged zones comprise a disaggregated structure, so that a net-like structure may be provided. The resistance of such areas against being displaced is too small for further processing. The physical, especially the mechanical properties are reduced in comparison to other fabric areas and are not homogeneous in all directions.

A further process for directly manufacturing a three-dimensional shell geometry includes weaving a cone as a two-layered area. Then the cone is cut out of the set of warp threads and spread (Rothe, H., Wiedemann, G.; Deutsche Textiltechnik 13 (1963) p. 95–101).

The invention is based on the object to avoid the disadvantages mentioned above. It is aimed at producing an arbitrarily three-dimensionally formed fabric zone the structures of which can be predetermined and set arbitrarily—independently of the three-dimensional form—especially with regard to density and homogeneity in the direction of warp and weft. The 3D shape is especially supposed to be stable.

SUMMARY OF THE INVENTION

The above and other objects and advantages of the present invention are achieved by the provision of a process and apparatus which includes interweaving warp and weft threads to form a fabric and forming a bulging zone in the fabric by changing the density of the crossing points by changing the number of yarns and/or changing the weave pattern.

A fabric is primarily defined by the number of the points of intersection as well as the number of crossing points thereof. The number of points of intersection per unit area is the product of the number of warp threads and the number of weft threads in this unit area. By crossing point is meant a point of intersection where a change of the warp threads involved between upper and lower shed has occurred.

According to the present invention, the number of crossing points in the three-dimensional fabric zone is changed. In smaller zones, it is possible to work with a constant draw-off speed of the warp threads running through the fabric zone which speed is equal across the width of the fabric.

Preferably, however, the draw-off speeds of the warp threads running through the fabric zone are varied, i. e.: increased, e. g. in order to avoid forming a preliminary fabric i.e. a woven structure in the track of the beat-up motion.

In order to compensate for the increased distances between the weft threads caused in this process, i. e.: the reduction of the number of points of intersection, the density of crossing points is increased beyond forming the 3D shape.

Because of the invention, it is possible not only to weave a three-dimensional fabric zone but also to control the structure of this fabric zone by influencing, i. e.: increasing or decreasing the number of crossing points per unit area—and in a limited way even the number of points of intersection per unit area—in a desired manner. Thereby, a lot of parameters can be influenced, such as, for instance, stability, elasticity, resistance to displacement, fabric thickness, atmospheric resistance, permeability and filtration characteristics towards liquids, optical effects (transparency, translucency).

The three-dimensional fabric produced is distinguished by an adjustable weight per unit area. Seams or double layers to cover seams are not necessary. The fabric is highly resistant to mechanical strain, as the density and homogeneity of the threads are adjustable and the threads are not damaged by subsequently being stretched or overstretched. A subsequent change in shape as a consequence of the threads shrinking because of latent tensions is avoided. The bulge can be exactly predetermined and exactly reproduced by computing. Clippings can be avoided, and the process provides a high productivity.

The invention is based on the idea to produce the three-dimensional bulge in a fabric by the purposeful application of different crossing point densities, i. e. different frequencies of interlacing between warp and weft. This is achieved by changing the weave structure and/or by tieing up or removing additional threads.

Thus, different to all known techniques, the production of three-dimensional fabric bulges takes place before the drawing-off process—independently of the number of points of intersection, i.e.: the number of warp threads and weft threads, namely by arranging the warp threads and weft threads. Increasing or decreasing the density of crossing points per unit area and increasing or decreasing the number of bindings leads to an increased surface of the fabric zone. Decreasing the density of crossing points per unit area leads to a decreased surface. A fabric zone with an increased surface bulges outward or inward to a three-dimensional shell compared to the rest of the fabric area. In this process, it is possible to increase the surface strongly such as to form cylindrical or even more strongly elevated lateral areas of the three-dimensional fabric zone.

If the zone comprises a reduced surface compared to the surrounding zone, the surrounding fabric bulges around this zone.

The processes of changing the weave structure and adding or removing threads can be combined, whether to adjust the bulge or whether to adjust the fabric density in the fabric zone.

It has already been mentioned that adjusting the distances between weft threads by changing the draw-off speed of the warp threads can be appropriate. In addition to the distances between the weft threads, the lateral distances between the warp threads can also be changed. This embodiment of the process has the purpose, especially in the very steep 3D areas, to distribute the lateral distances of the warp threads and/or weft threads in a purposeful manner in order to achieve freedom in designing the distribution of the crossing points. Warp threads and weft threads can be distributed across the bulge such as to follow certain zones of stress. By drawing off the warp threads more rapidly, forming a preliminary fabric is avoided in the places in which a larger surface is produced. In controlling the lateral distance of the warp threads, purposeful courses of threads can be combined with 3D geometries produced by weaving techniques, such as is required by the mechanical demands on a fiber reinforced plastic component, for instance.

As has been mentioned, the adjustment of the distances of weft threads occurs by producing different draw-off speeds of the warp threads.

The adjustment of the distances of the warp thread occurs by controllable weaving reeds. As an example, there is known a fan-like weaving reed in which dents (staves) run from the lower or upper longitudinal center of the weaving reed in the manner of a fan. Such weaving reeds have been used in the past to influence the width of a fabric, especially of a weaved ribbon, by changing the distance between warp threads (cf.: International Trade Bulletin, p. 2/1993). For this purpose, these fan-shaped weaving reeds are moved more or less in a stroking manner. According to the invention, this movement is substantially continuous and adapted to the desired changes of the 3-dimensional shape of the fabric.

Another example is a weaving reed with controllably displaceable dents (DE-OS 41 37 082).

It is desirable that the fabric produced is homogeneous in both directions (warp and weft) in spite of different distances between the points of intersection. This is the purpose of the process wherein the different distances are compensated for, in whole or in part, by changing the number of crossing points. Now, in each direction, net-like places in the fabric can be avoided and the physical characteristics of the fabric can be influenced. Thereby, the crossing point density or—amounting to the same thing—the number of bindings does not only compensate for different distances between intersections along a warp thread, but also transversely thereto, i. e. along a weft thread.

The number of warp threads and/or weft threads tied up can be varied by individual warp threads or sets of warp threads not being involved in forming sheds in areas of the fabric, so that the warp threads or weft threads, respectively, are only tied up in other areas, i. e. especially in the 3-dimensional areas, but float laterally thereto. In this process, the warp threads not being involved in forming the sheds preferably remain positioned in the lower shed so that the floating lengths of the weft threads do not hang down into the weaving machine.

According to the invention, it is therefore provided that the number of warp threads and/or weft threads tied up in areas of the fabric which are formed 3-dimensionally varies, or that another weaving structure is provided. In both cases, the process can be carried out by a multiple-shaft machine. Nowadays, machines with up to 24 shafts are used. By suspending the threads on different shafts and differently driving the shafts, it can be achieved that the sets of warp threads being guided on different shafts can be involved in forming the sheds in different ways.

It is especially appropriate for this purpose to use a jacquard machine, which can individually raise and lower all the warp threads between upper shed and lower shed according to a program in order to form the sheds.

The warp threads as well as the weft threads may be tied up in certain fabric areas while floating in others. Where the warp threads and weft threads, respectively, are tied up, the density of the fabric increases in any case, but in some cases also the surface of the fabric increases, and—in turn—the density of the fabric decreases in any case, but in some cases the surface of the fabric where the threads float decreases as well.

To use a shuttle weaving machine provides the advantage that—depending on the width of the three-dimensional fabric zone—the weft threads are only inserted in the three-dimensional fabric zone and do not float in the rest of the fabric areas. These additional threads have, to a far extent, the same effect as the floating threads mentioned above, except for the fact that the thread length thereof is adapted to the width of the fabric zone involved. The subsequent cutting-off process of occasionally long, protruding thread ends is eliminated. Furthermore, the amount of material to be employed is reduced because of the reduced occurrence of clippings.

A very large number of threads can be inserted additionally into the three-dimensional fabric zone in the case of fabrics with multiple layers. For this purpose, fabrics with multiple layers are produced. In the area of the three-dimensional fabric zone, threads are transferred and inserted from a dissolved or thinned fabric layer determining the three-dimensional shape of the fabric zone. Thus, the fabric density remains substantially the same, as also the number of threads inserted remains the same. However, the possibility of a three-dimensional bulge is increased considerably by the large number of additional threads available for the three-dimensional thread zone.

To change the number of threads tied up in the bulging zone, a weave pattern with a changed, preferably increased density of crossing points and a correspondingly changed or increased number of thread bindings. This is especially effective to achieve a three-dimensional fabric zone. It allows for providing a changed, i. e. generally an increased density of crossing points or a larger number of thread bindings than in the surrounding fabric zone.

The distance between two neighboring threads (e. g. warp threads) is influenced by the number of times the threads of the respective crossing thread system (e. g. weft threads) pass through, as the threads are pushed apart at a binding or crossing point. The more passages or crossing points are present per unit area, the larger the distances between the threads. For example, in a plain weave, the distances are at a maximum because of the highest density of crossing points, in a simple twill weave, they are smaller, and in a long floating satin weave still even smaller. If an at least partially enclosed fabric zone with an increased crossing point density per unit area is produced in a fabric with a low crossing point density per unit area, a three-dimensional shell shape is already produced because of the layer surface of this fabric zone. This process simplifies the production of three-dimensional fabric bulges in so far as the forming of the preliminary fabric can be controlled at selectable locations and this preliminary fabric only has to be compensated for by producing different draw-off speeds. The homogeneity or other structural properties of the fabric can therefore be controlled independently of the geometry of the fabric.

On the one hand, the process according to the invention causes the formation of a three-dimensional fabric zone by changing the weaving structure and/or the number of threads inserted; on the other hand, the changed distance between points of intersection of the three-dimensional fabric zone can be compensated for; apart from that, favorable possibilities of design for the textile, mechanical or physical properties of the fabric zone are a result.

Broad technical applications become possible by these designs to set the mechanical and/of physical characteristics of the bulging zone.

In this, stability, elasticity or resistance to displacement can, among other things, be set independently of the direction in the direction of warp or weft. This is especially advantageous when mechanical stress for a fabric is defined, as in the case of a housing of fiber reinforced material, which is to support a load.

With the aid of the weaving pattern and thread-filling techniques described above, fabric structure, fabric density, local wall strength can be adapted to mechanical requirements.

The fabric is suitable as a filter material for air, gas and liquid filters, as permeability and filtration are adjustable and independent of the geometry of the three-dimensional fabric zone.

Optical effects, such as patterns, become adjustable independently of the geometry of the three-dimensional fabric zone in cases where not only the technical properties of the seamless three-dimensional fabric but also an agreeable look and pattern are decisive.

The three-dimensional fabric zone can also be part of a hollow body. For this purpose, the fabric zone can be connected areally to a plane or another three-dimensional fabric zone, e. g. by sewing or adhesion. This operation is replaced by an automated process. In this process, a fabric is woven with at least two layers which are guided separately in the area of the three-dimensional fabric zone and are only brought together and connected closely to each other or tied up at a place behind the three-dimensional fabric zone. Thus, a space or a hollow space, respectively, is produced between the fabric layers. Such hollow spaces are advantageous if, for instance, individual fabric layers are supposed to be displaced against each other or removed from each other during further processing or in operation. For this purpose, the structure proposed herein does not have to be composed of individual pieces any more.

The space between the connected fabric layers would adopt a substantially arbitrary shape when filled with gas, liquid or loose material. This is avoided in that so-called binding warp threads may be tied up regularly or irregularly between upper and lower layers with a predetermined floating length In this, binding warp threads are such warp threads that are tied up floatingly, over distances, in the one or the other fabric layer, respectively, changing regularly or irregularly, and have a predetermined length. These binding warp threads are subjected to tensile forces when the hollow space is inflated with gas, liquid or loose material, thus limiting the local space between the two fabric layers. The spaces between the fabric layers lying above each other can thus be adjusted by the floating lengths of the binding warp threads. Thereby, the two fabric layers can obtain defined space profiles. At the same time, it is especially advantageous to use the binding warp threads as filling to control the three-dimensional shape and/or the fabric density. In this process, the three-dimensional fabric zone can seamlessly enclose a large part of the air bag hull.

The production of two fabric layers connected by binding warp threads and tied up changingly between the upper and lower layers as spacers is known from the production of velvet, for example. There, these binding warp threads serve as pile threads after the fabric layers have been separated.

Such a double fabric is advantageously applicable as an air bag to avoid injuries in motor vehicle accidents. Because of the length of and the tensile stress to the binding warp threads, the shape of the inflated air bag is limited such that it does not hit driver or passenger in the face in the case of an explosion, injuring them. The air bag according to the invention contains substantially less seams than in the past. This reduces the overall weight of the air bag, especially in places where a human being bumps on the air bag.

When being filled with a liquid, solid, loose or foaming (expanding) material or with a curing liquid or when soaking the inflated fabric with a curing liquid, bodies with a seamless fabric cover can be produced in this manner.

The threads used for the process according to the invention can consist of natural fibers, especially linen, cotton, hemp, jute etc. Synthetic threads are another option. As the three-dimensional shape is produced by weaving in one operational step, the threads do not have to be plastically deformable, or just to a small extent. The proposed processes and products according to the invention are especially suited for such materials, as the deformability of the material, which is very small at first, does not have an effect any more when a bulge is produced.

The three-dimensional formation can be increased and supported by providing that, the bulge, which can be cylindrical or hemispherical, for example, be positioned within a two-dimensional fabric area which annularly encloses the bulge wholly or in part.

The two-dimensional fabric area can then be cut away or be utilized together with the rest. Such a structure can especially be formed as a hat, the two-dimensional ring-shaped fabric area of the three-dimensional—e. g. hemispherical or cylindrical—bulged fabric zone serving as a brim.

Versatile forms of such a fabric zone include the shape of a cylinder which is open on one end and is provided on the other end with a plane or hemispheroid end with a central opening. The bulging zone may also have the shape of a partial sphere or hemisphere.

The fabric zone provided as a hemisphere or a spherical zone is especially suited for parts of garments, which, according to the weaving process of this invention, can be adapted to the shape of the body when being woven, without comprising any irritating seams in the area of the bulge afterwards.

An important area of application for such fabrics are orthopedic and medical supporting fabrics which can be adapted seamlessly to a part of the body, e. g. head, chin or foot. Such seamless supporting fabrics with adjustable density are advantageous especially when the fabric has to stay fixed to the body for a long time (for example after a jaw or skull fracture). The supporting fabrics do not cause any pressure marks when worn over a longer period of time.

Another important area of application are parts of outer garments, underwear or swimwear, especially for ladies. Thus, a fabric zone in a hemispherical shape can be employed in the area of the breast as a support or as part of the bra. This support has the advantage that no seams or metal reinforcements are required, which are uncomfortable and pinch when worn for a longer period of time.

Elongated fabric profiles can also be formed. A suitable application of such a fabric zone is a sail which is given the shape of an airfoil profile in one area. The otherwise usual seams are eliminated, whereby the flow bears on the sail in a better way and the energy is used more efficiently, as less turbulence arises.

Another important field of application are filter cloths. These have the advantage that a seamless, homogeneously designable filter surface with a desired three-dimensional form and with certain filtration properties for passing through or holding back substances and/or particles can be produced.

Finally, the process can be used to produce self-supporting bowls, vessels, containers or similar items with a fabric reinforcement, which are applied either as such or as reinforcement inserts for plastic bodies and plastic profiles. In the simplest of cases, such a form body can be produced by coating and/or soaking the bulging zone with a curable liquid plastic.

Alternatively, threads of a first material and threads of a second material can be interwoven, with the second material being settable by thermal or chemical treatment. When subjected to such treatment, the second material is set to thereby form a continuous three dimensional rigid matrix which includes the threads of the first material as a reinforcement. Thus a rigid, reinforced form body may be easily produced in just one or two steps, respectively—weaving and thermal or chemical treatment.

As fiber reinforcements, such three-dimensional fabric zones and form bodies have the advantage of being homogeneous without deep-drawing or cutting work and being formed with a constant quality. The weight distribution of fibers and matrix materials is already fixedly predetermined by the production of the fabric.

A fabric zone in the form of a cylinder having an open end can especially serve as a fiber reinforcement for a hub of a wheel or a rim.

Shell-shaped fiber reinforcements according to the invention are suitable for containers or crash helmets or safety helmets.

Such a container can contain two such fabric zones which are installed at the interior side and the exterior side of the matrix of the helmet. As the fiber reinforcement according to this invention neither comprises seams nor has to be adapted to the three-dimensional helmet shape by overlapping several plane layers, and the fiber courses therefore are not interrupted anywhere, especially not at the forehead or head sides, the fiber reinforcement withstands the stress in spite of only small amounts of material being used. As hardly any manual interference is required in the production, the fiber insert can be produced in an always similar and precalculated quality and position within the helmet shell.

Thus, the invention ensures the production of three-dimensional fabrics with freely selectable geometries and closed surfaces or surfaces which are adjustable to different requirements. Geometries and thread structures are freely controllable with the aid of the existing shedding mechanism. Especially freely programmable electronically controlled jacquard machines in are a suitable means for putting into practice the process according to the invention. The inputted control programs allow for the arbitrarily often exact reproduction of predetermined fabric bulges with a predetermined fabric structure.

BRIEF DESCRIPTION OF THE DRAWINGS

Some of the objects and advantages of the present invention having been stated, others will appear as the description proceeds, when considered in conjunction with the accompanying drawings, in which.

DETAILED DESCRIPTION OF THE PREFERRED EMBODIMENTS

Figure 1:
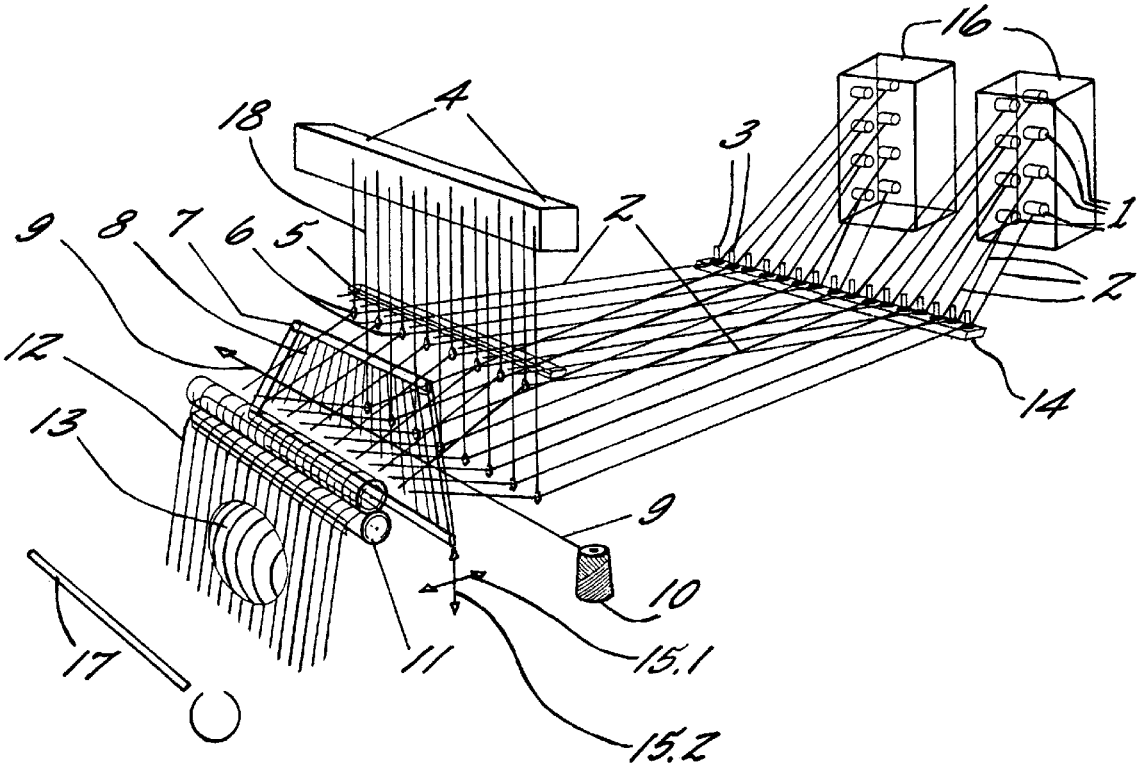
FIG. 1 shows a weaving machine.

FIG. 1 shows a weaving machine with its elements, which are necessary for the embodiment of the present invention. Individual warp bobbins 1 are presented to the weaving machine. The warp bobbins 1 are creeled on a creel 16. The warp threads 2 are drawn off the bobbins and then guided individually through the individual elements of the weaving machine. In this application, reference is made only to one warp thread; however, it should be noted that this can always also mean two or three or a set of warp threads.

First of all, the warp thread is guided through one of the brakes 3. Each brake can be set individually. This can occur manually.

Figure 2:
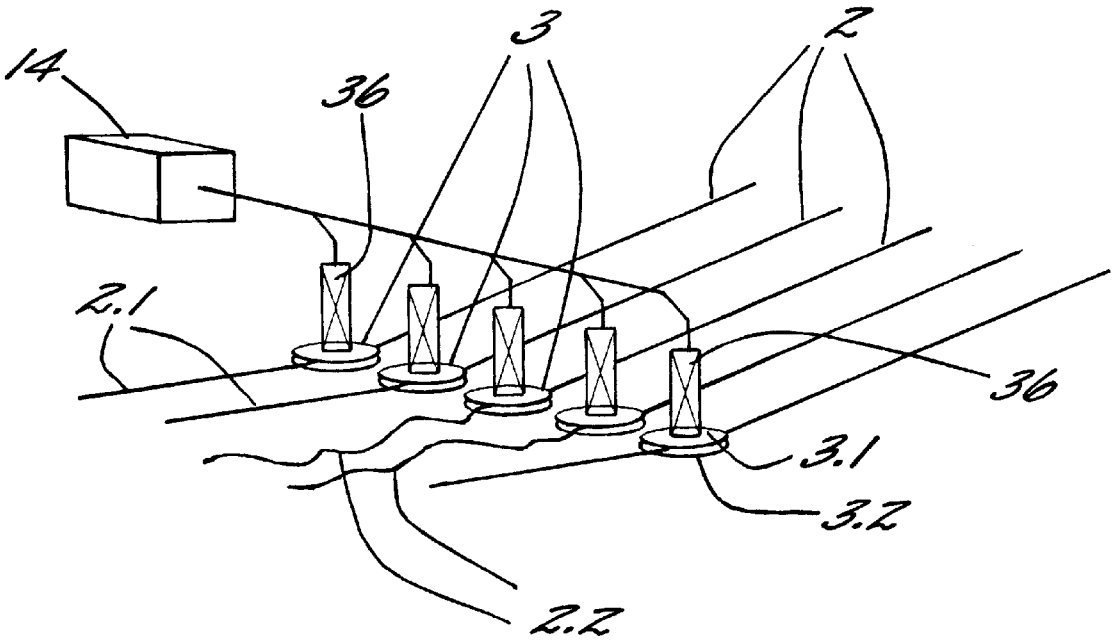
FIG. 2 shows the braking means as a detail.
Figure 6:
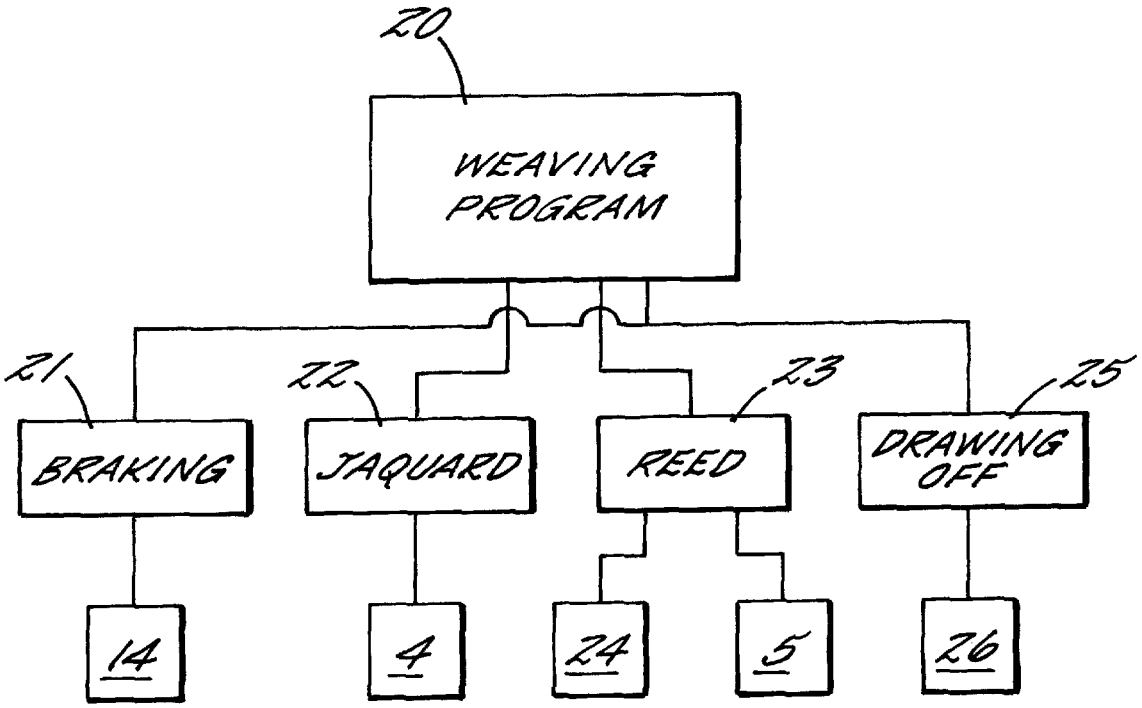
FIG. 6 shows the program and control diagram.

In the embodiment according to FIG. 2, each brake 3 consists of a lower plate 3.2 and an upper plate 3.1. Each warp thread 2 is drawn therethrough between such a lower plate and such an upper plate. The lower plate 3.2 is arranged in a fixed place; the upper plate 3.1 is attached to the rod of an electromagnet 36 and can be pushed against the lower plate 3.2 with a force which can be preset. The electromagnets 36 are individually addressed by braking means 14 and braking program 21 (FIG. 6). Thereby, the braking force and the thread tension in the warp threads 2.1 can be adjusted differently. On the other hand, the adjusted individual warp thread is also dependent on the draw-off mechanism 11 and the individual draw-off speed thereof for each single warp thread, as the program steps of the braking program unit are gathered depending on the draw-of f speed of the warp thread. This will be explained in greater detail with reference to FIG. 6. Thereby, the brakes are individually controllable in the course of the weaving process. It is a matter of course that the brakes are constantly adjustable even during the weaving process.

The jacquard control 4 serves to move the warp threads up and down. Harness cords 18 are suspended in this jacquard control 4. From the harness cords 18, heddles are suspended, and eyelets 6 are suspended from these. The eyelets are moved upwards by the harness cords and the jacquard control and brought into an upper position (upper shed). The eyelets 6 are connected downwards by rubber strings 33—shown in FIG. 3—, wherethrough the eyelets are drawn against the force of the jacquard control into a lower position (lower shed).

Figure 3:
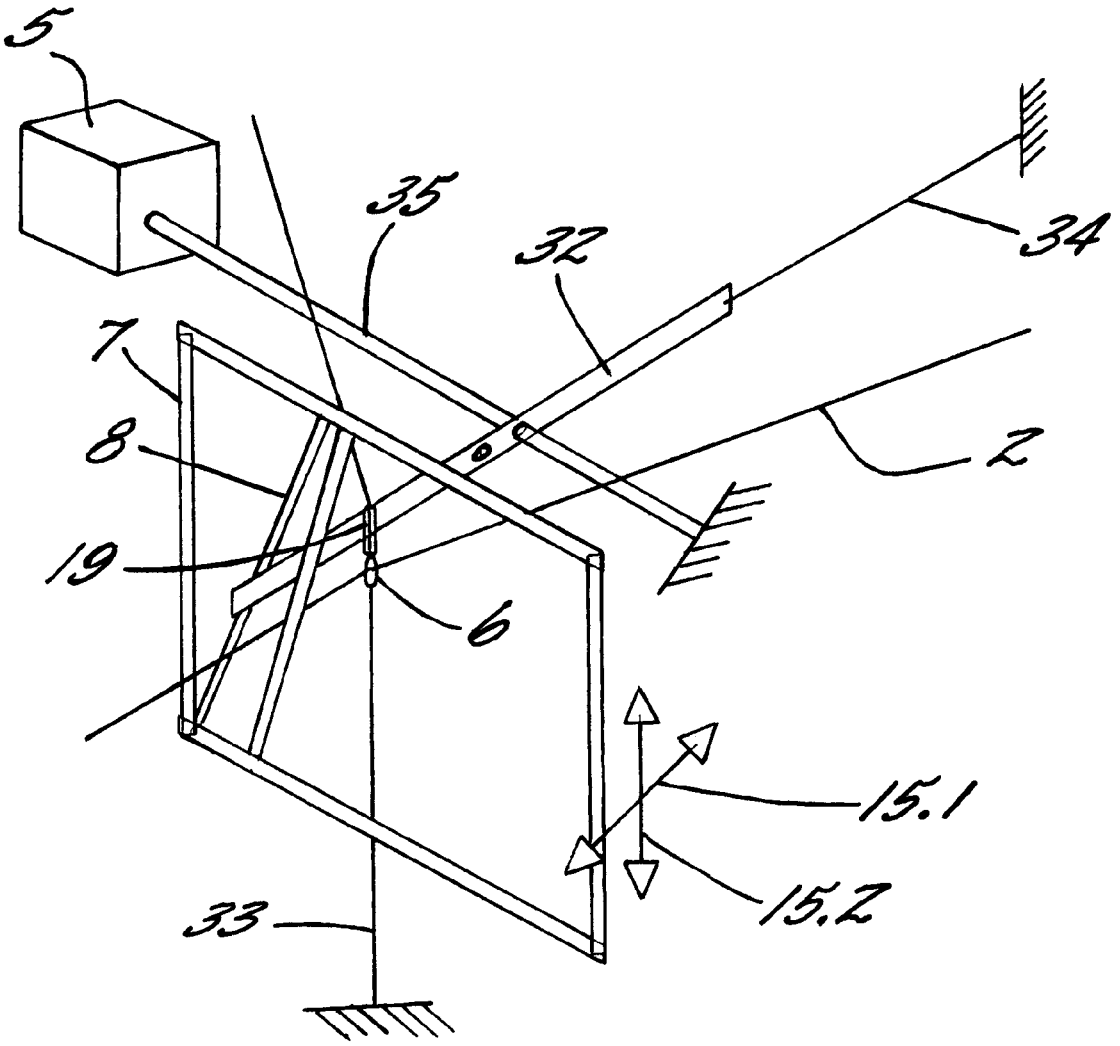
FIG. 3 shows the positioning of the warp threads as a detail.

The heddles 19 are small longitudinal metal tongues which can be seen in FIG. 3. The warp thread positioning means 5 is arranged in front of the eyelets 6. By means of this warp thread positioning means, the harness cords 18, or the heddles 19 or the eyelets 6, respectively, are positioned laterally such that the eyelets substantially have the same distance as the warp threads running through the weaving reed 7 (see below).

Each warp thread is guided behind its brake through an eyelet of the eyelets 6 each. By means of the jacquard control 4, each warp thread is moved, independently of the other warp threads, into the upper shed or the lower shed according to the jacquard program unit 22.

The weave structure of the fabric as well as the number of tied up threads depends on the jacquard control, i. e. on which of the warp threads are moved to the upper or the lower shed in each filling.

The weaving reed 7 is arranged behind the jacquard means.

The weaving reed 7 is a frame in the shape of a trapezoid or a parallelogram. Between the upper edge and the lower edge running parallel thereto, dents 8 (staves) are fitted such that the dents lead apart from the upper edge in the shape of a fan. Such a weaving reed is shown in DE 39 15 085 A1, for example. Each warp thread is guided through a space between the dents 8. The forward movement 15.1 (FIG. 3) of the weaving reed, by means of which the last weft thread is pressed to the edge of the fabric after each filling, and the backward movement of the weaving reed 15.1 are caused by the machine control, e. g. a crank mechanism (not shown).

By means of the slow upward or downward movement 15.2 of the weaving reed (FIG. 3), the lateral distance of the warp threads in the weaving reed and behind that is determined.

Even the positioning means 5 guides the warp threads through the eyelets of the jacquard means with the lateral distance already predetermined by the weaving reed.

The upward and downward movements 15.2 is controlled by the weaving reed control according to a predetermined program.

The weft insertion of the weft thread 9 takes place behind the weaving reed. The weft thread is drawn off the weft bobbin 10 and guided through the shed by means of gripping devices. However, any other weft insertion systems are possible, especially the weft insertion by shuttles (weaving shuttle).

The resulting fabric 12 can be drawn off by individual gripping devices. A cloth beam 11 is employed here. The cloth beam 11 is separated in individual and individually drivable roll segments, i. e.: rollers of a small width. The resulting fabric is clamped between the rollers and the freely rotatable opposite rollers. Now the individual roll segments are driven individually by the drawing-off control 25 and the drawing-off program 26 (FIG. 6). In order to form a plane fabric or a plane area of a fabric, the roll segments are moved at the same speed after each filling 9. When forming a three-dimensional fabric zone, it is advantageous to move the roll segments at different speeds after each filling 9.

Thereby, the warp threads of the fabric zone are given an individually controllable draw-off speed.

A suitable cloth beam separable into segments and the drive there-of is also shown and described in DE 39 15 085 A1.

As mentioned above, the braking control is operated synchronously and in dependence on the drawing-off control.

The fabric can then be wound on the cloth draw-off beam 17.

Figure 4:
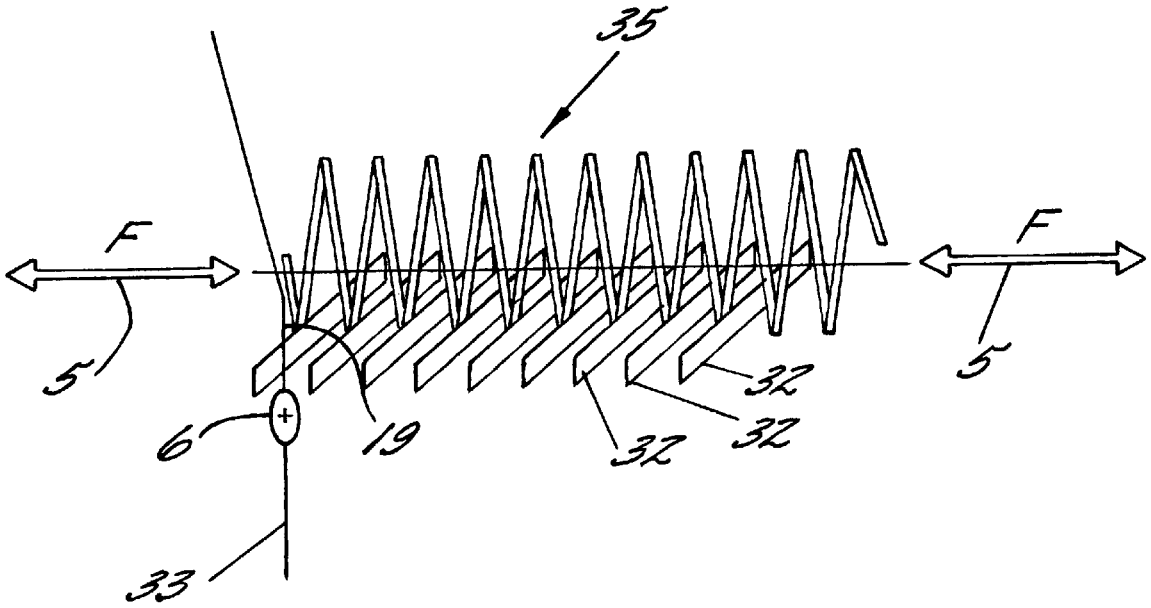
FIG. 4 shows the positioning of the warp threads by helical springs.

FIG. 3 and FIG. 4 show the positioning of the warp threads before being guided into the weaving reed 7 in detail. Only the frame and two dents 8 are represented of the reed. The dents 8 run outward from the upper edge in the shape of a fan. Furthermore, only the warp thread 2 is represented running through the space between the represented dents 8.

A set of parallel guiding rods 32 extending substantially parallel to the warp 2 serves for positioning the heddles 19 with eyelets 6 and harness cords, respectively. For the sake of clarity, only the guiding rod 32 is represented, which serves to guide the represented heddle and the represented warp thread. As do all of the guiding rods, this guiding rod 32 also projects into the same space between two dents 8 through which the corresponding warp thread 2 to be guided runs as well. The other end of each guiding rod 32 is held by an individual elastic band 34 in the warp direction as well as by an elastic band 35 in the weft direction shared by all the guiding rods. The shared elastic band 35 can be expanded elastically by the positioning control 5 to a more or less great extent. Thereby, the distance of the fixation points of the guiding rods 32 on the elastic band 35 changes. As an alternative, the shared elastic band 35 can be replaced by an equally (in the weft direction) directed guiding ridge whereon the guiding rods 32 slide. In this case, the guiding rods are positioned with sufficient precision only by the horizontal distance or the dents guiding the leading ends of the guiding rods. Thus, the horizontal distance of the guiding rods is only determined by the vertical position of the weaving reed without a further positioning control being necessary.

The shared elastic band 35 can also be replaced by a helical spring 35 (FIG. 4). The helical spring extends in the weft direction. Its coils engage between adjacent positioning rods 22. The helical spring 35 is tensed by the positioning control 5 with a force F to a more or less great extent. Thereby, the pitch of the coils and thus the distance of the rear end of the positioning rods 32 changes.

The distance of the leading ends of the guiding rods is predetermined by the respective vertical position of the weaving reed 7. Both distances are aligned with each other by the vertical weaving reed control on the one hand and the positioning control 5 on the other hand.

As any guiding rod bears on a heddle 19, guiding it laterally, the heddles are given the distance of the dents 8. Thereby, the warp threads run through the weaving reed without a significant deviation. Friction and production of undesired thread tractions are avoided. The thread traction force can only be predetermined by braking and by the take-down device.

Figure 5:
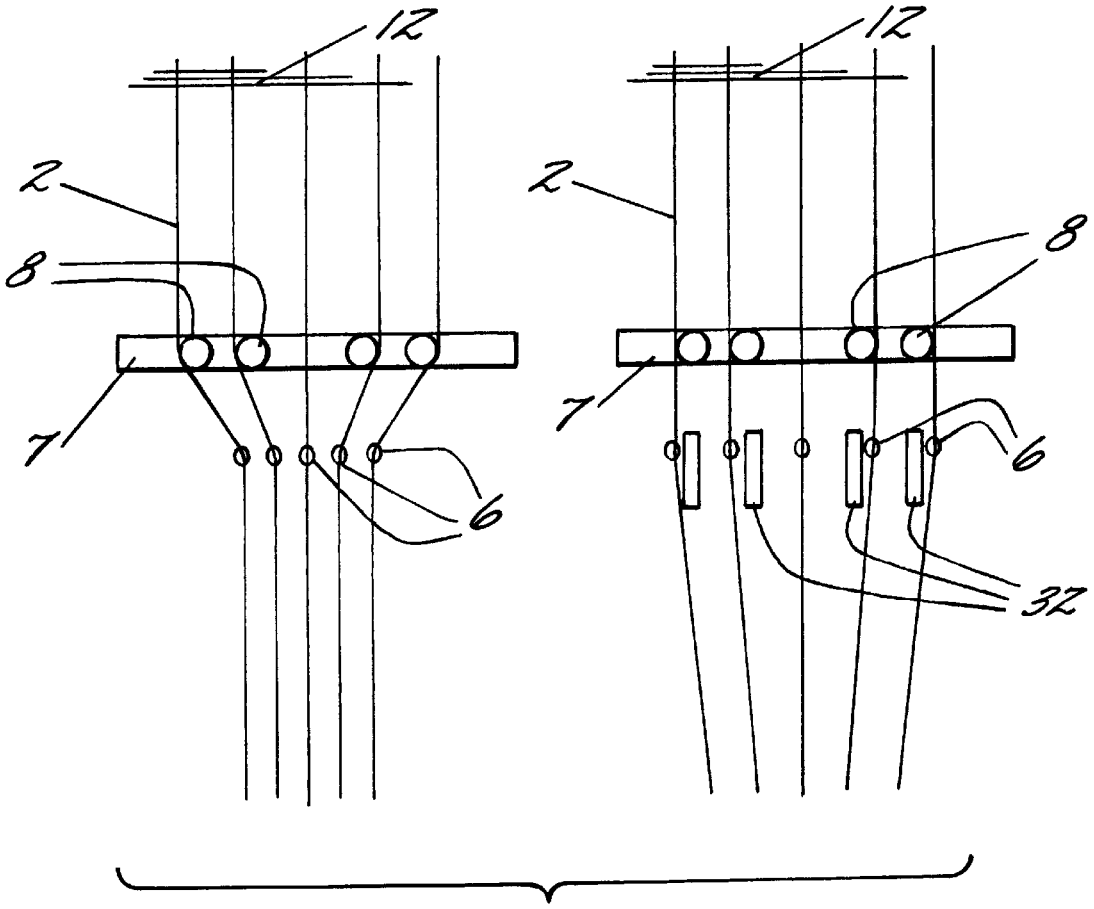
FIG. 5 shows the guiding of the warp threads with and without a positioning means.

FIG. 5 shows a top view of this warp thread guiding between the jacquard means and the fabric edge of the fabric 12. Only some parts of the weaving machine are represented in top view, these being the weaving reed 7 with dents 8, the eyelets 6 of the jacquard control, some warp threads 2 as well as the edge of the fabric 12. On the left side, the top view of the guiding of the warp threads without a positioning means is represented. The warp threads are redirected both at the eyelet 6 of the jacquard control as well as at the dent 8 of the weaving reed 7, when the distance between the warp thread is increased by the fan-like weaving reed, as is represented here as an example.

On the right side, the top view of the guiding of the warp threads with a positioning means 5 is represented. The heddles and eyelets 6 are held at a distance towards each other corresponding to the distance of the warp thread in the current vertical position of the weaving reed by the positioning rods 22.

By the redirection of the warp threads which is produced without the positioning means, an uneven warp thread tension is built up in the set of warp threads. It has turned out that this is the cause of deviations of the three-dimensional fabric zone from the precalculated form. The positioning means also avoids abrasion and wear of the warp threads.

FIG. 6 shows a schematic view of the cooperation of the individual controls and the corresponding programs. The weaving machine is controlled by the superordinate weaving program 20. This is predetermined by the three-dimensional fabric which is to be produced. The weaving program fetches the individual program steps of the subordinate programs 21, 22, 23, 25. The subordinate programs are:

the braking program 21; this addresses the braking control 14. The brakes 3 for each warp thread 2 can be set individually or in sets or altogether and depending on the instruction steps of the drawing-off program 25.

the jacquard program 22; this operates the jacquard control 4. Each harness cord 16 can be drawn upwards individually or in sets with others to form the upper shed or downwards by the elastic band to form the lower shed. The jacquard program is predetermined such that the weaving structure and/or the number of threads tied up is changed and set according to the predetermined three-dimensional shape of the fabric zone to be formed.

the weaving reed program 23; this addresses the weaving reed control 24, thus predetermining the vertical position of the weaving reed in the direction 15.2. This influences the lateral distance of the warp threads and thus the density of the points of intersection. At the same time, the positioning control 5 is controlled such that the lateral distance of the warp threads from the weaving reed corresponds to the distance the warp threads are given by the respective vertical position of the weaving reed.

the drawing-off program 25; this addresses the drawing-off control 26 and thus predetermines the speed of the roll segments of the draw-off mechanism 11 individually or in sets or altogether. The start of the drawing-off program is synchronized with the start of the braking program. Thereby, the braking operation of the individual thread is adapted to its draw-off speed.

To put the invention into practice, at first a plane fabric homogeneous across the length and width thereof is produced. This fabric is characterized by the number of points of intersection per unit area, the number of crossing points with a binding of a warp and a weft thread, the number and length of the floating threads as well as—if desired—the number of the fabric layers.

In order to form a three-dimensional fabric zone 13,—e. g. according to FIG. 7*ff*.—the crossing point number, i. e. the number of crossing points with a binding of warp and weft thread each, is increased or decreased in a zone of the fabric, either at the longitudinal edge or at a central area of the sheet. This occurs by changing the weaving structure and/or by changing the number of threads tied up.

The number of threads tied up can be increased by taking along floating threads in the plane fabric area or in other fabric layers, thus having ready a "supply" from which threads can be "taken out" and tied up in the three-dimensional fabric zone. Thereby, increased lengths of warp and/or weft threads are tied up in the fabric zone. Consequently, the mutual repulsion of the warp and weft threads changes in this fabric zone, and the fabric zone bulges in a three-dimensional manner.

Therefore, it is suitable to increase or decrease the draw-off speed of the roll segments concerned of the draw-off mechanism with regard to the warp threads to avoid a fabric surplus at the cloth beam.

It should be noted that, in the state of the art, the difference in speed of the warp thread being drawn off leads to the three-dimensional bulge of the fabric. Thus, this three-dimensional bulge is based on a change in the number of points of intersection. It can only be relatively weak; above all, it leads to a "thinning and weakening" of the fabric, thus not being very stable.

According to the invention, however, the three-dimensional shape is forced on the fabric by changing the crossing point number and therefore by changing its internal structure. Changing the speed of drawing off warp threads is not the cause of the three-dimensional shape, but only a possible, but not necessary secondary measure, which is preferably compensated for by further changing the crossing point number with regard to the density of the fabric. Changing the speed of drawing off the warp threads is not necessary, especially not in the case of smaller 3D shapes or when large sheds are being formed.

To support and modify the three-dimensional form of the fabric zone, the distance between warp threads and thus the number of points of intersection per unit area can additionally be changed by moving the weaving reed up or down. This measure can also be compensated for with regard to the density of the fabric by further changing the crossing point number.

Changing the weaving structure or the number of threads tied up occurs by changing the rhythm of shed formation (moving the jacquard eyelets 6 upward or downward).

Further details are described referring to FIGS. 7 to 17.

Figure 7:
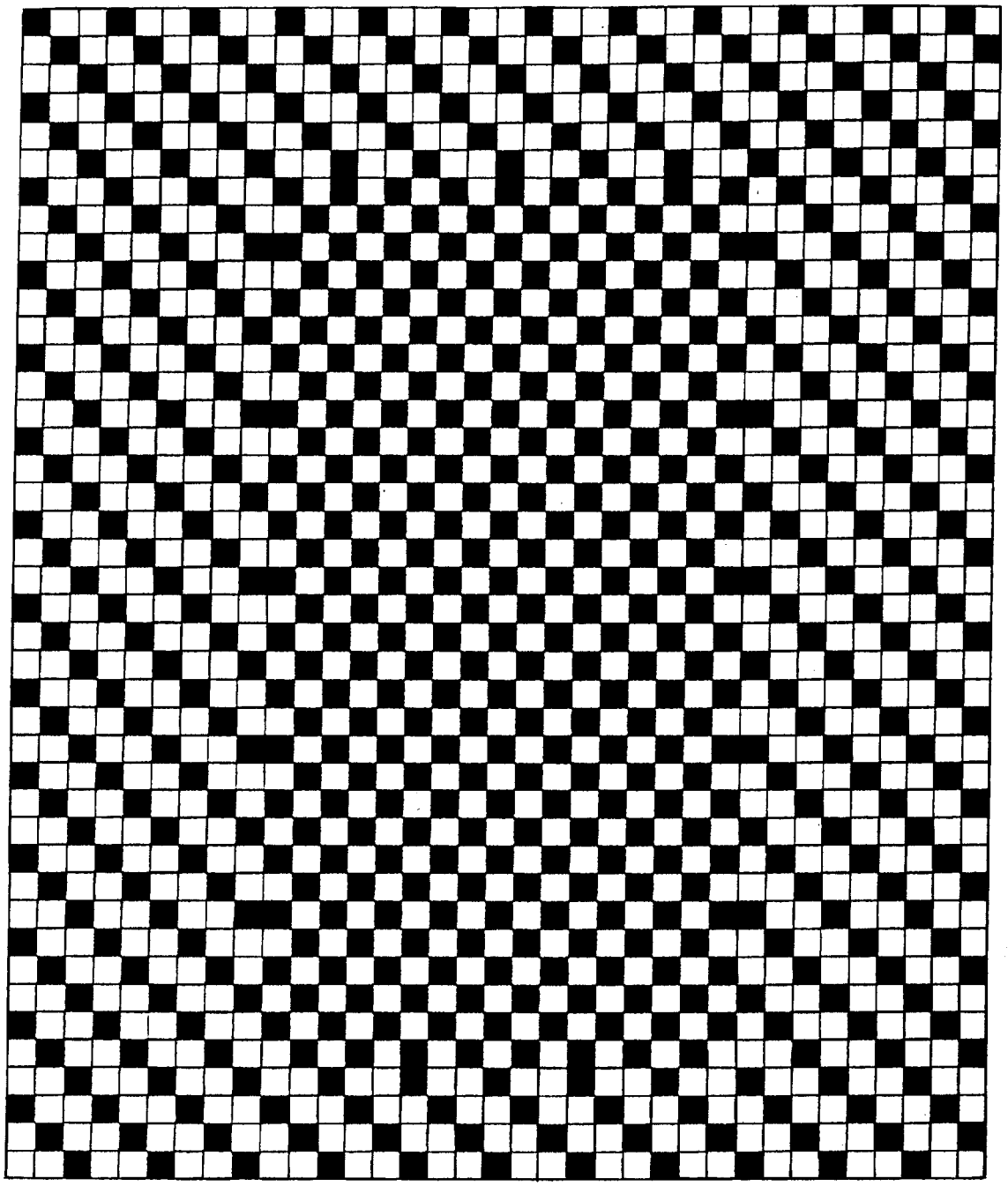
FIG. 7 shows a fabric zone with an increased crossing point density per unit area, surrounded by a zone of a lower crossing point density per unit area.

FIG. 7 represents a fabric enclosing a fabric zone of increased crossing point density (crossing point number). As an example, the surrounding fabric is designed as a body weaving. The enclosed three-dimensional fabric zone comprises a linen weaving. In this zone, the frequency of warp/weft thread bindings is increased compared to the surrounding fabric. Thereby, the threads are spread further apart and occupy a larger surface than the surrounding body weaving. The zone woven in a linen weaving thus bulges out compared to the surrounding area or forms a constantly increasing preliminary fabric when being woven. In the area of this zone with a linen weaving, it is advantageous to draw off the fabric at an increased speed so that this formation of a preliminary fabric does not lead to disturbances. The points of intersection drawn off at the increased speed would comprise larger distances if the linen weaving did not increase the number of bindings at the same time. Therefore, the linen weaving has a compensatory effect on the increased distances between points of intersection.

Figure 8:
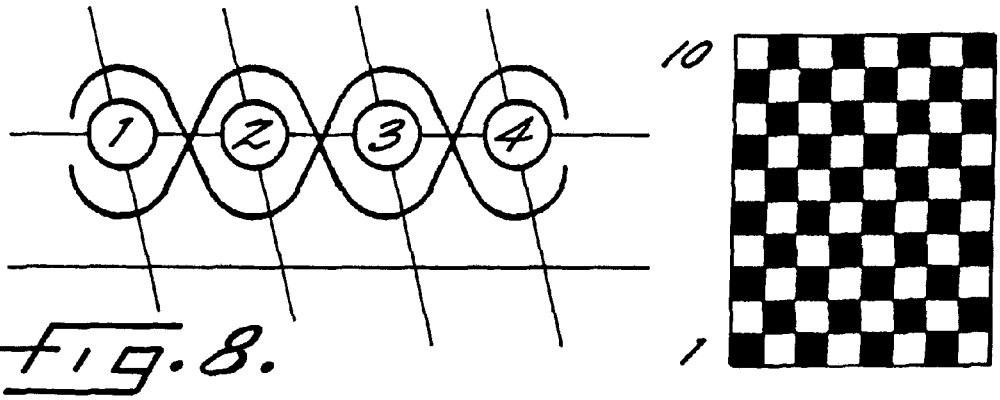
FIG. 8 shows a cross section and weave design of a linen weaving.
Figure 9:
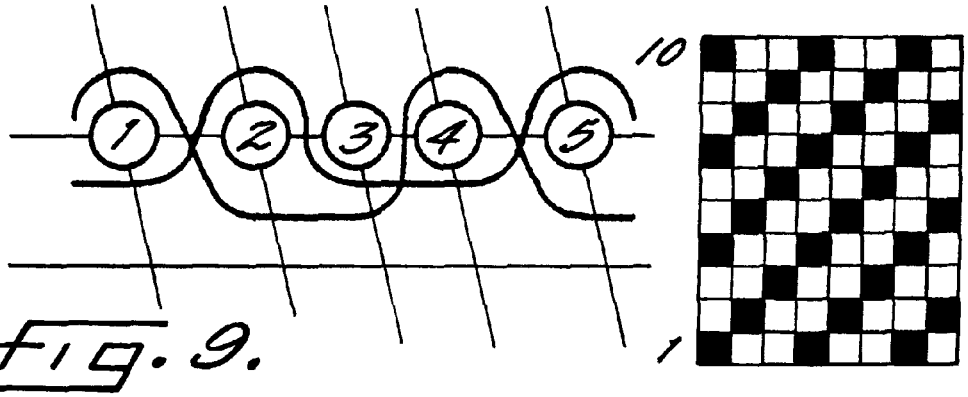
FIG. 9 shows a cross section and weave design of a body weaving.
Figure 10:
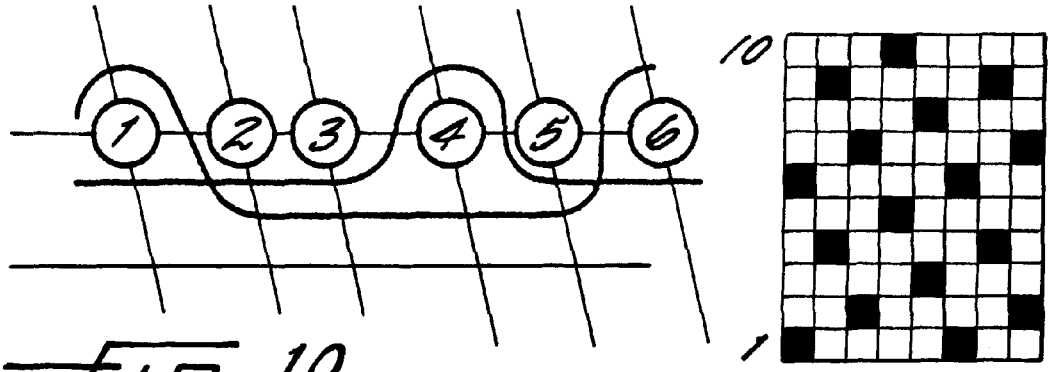
FIG. 10 shows a cross section and weave design of an atlas weaving.

FIGS. 8 to 10 represent three weaving structures, each comprising different binding frequencies and therefore requiring different spaces for the processed threads.

FIG. 8 shows a linen weaving which results in the highest thread distances both in the warp and in the weft direction.

Compared to that, the body weaving of FIG. 9 has a lower number of bindings and smaller thread distances. Without changing the number of threads, smaller fabric surfaces than in the case of the linen weaving are the result.

The five-end atlas according to FIG. 10 guides the threads very closely to each other and thus occupies an even less extensive area.

The crossing point density of the three weaves shown in FIGS. 8 to 10 decreases from top to bottom in the arrangement of the figures. The different crossing point densities per unit area and therefore the spatial relations specific to the weave are used to obtain closed surfaces in the area of three-dimensional bulges and to avoid net-like places caused by the geometry.

Figure 11:
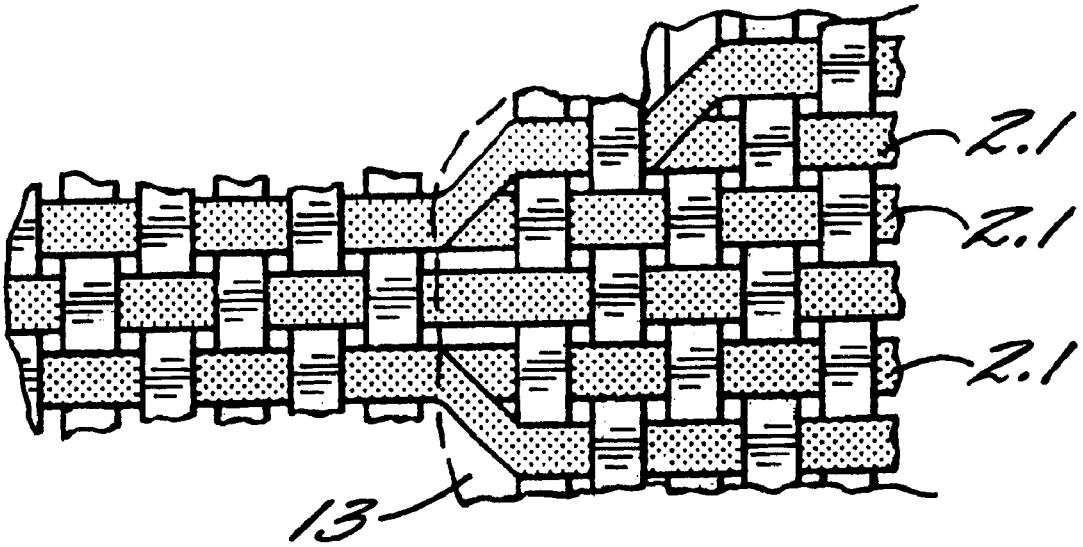
FIG. 11 shows the application of additional threads inserted over distances.

FIG. 11 shows the process, if a three-dimensional shell geometry is supported with the aid of additional threads tied up over distances or is adjusted to special requirements. Before the shell bulge is produced, warp and weft threads are taken along in the fabric in a layer lying above or below the plane which is bulged later on, which threads are not tied up in this plane. In certain places, these threads taken along are inserted, e. g. as warp threads 2.1, in a linen weave into the fabric plane/layer which is to be bulged. With the distances between the points of intersection remaining unchanged, the threads which have been woven below or above the plane to be bulged now replace the threads already present in the plane, thus leading to an enlargement (if threads are taken out of this plane, to a reduction) of the size of the area. This process leads to the desired bulge. On the other hand, it can also be used to adjust the characteristics of the fabric in spite of changing draw-off speeds and changing distances between points of intersection, for example mechanical behavior, permeability and resistance to displacement.

Figure 12:
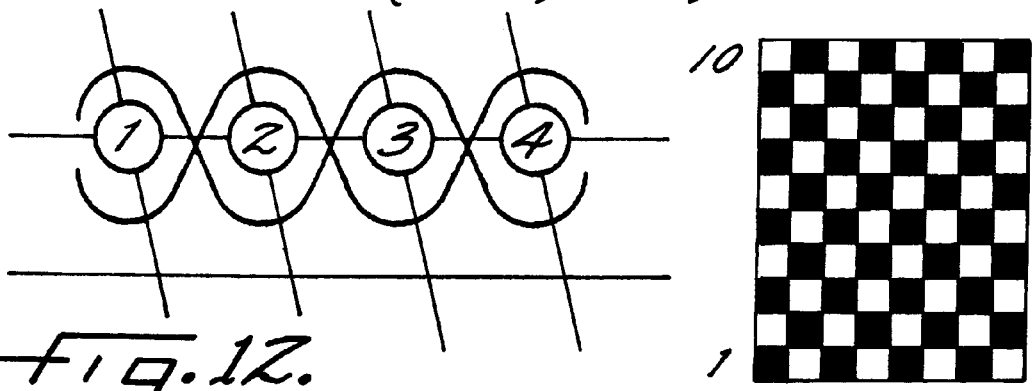
FIG. 12 shows a cross section and weave design of a linen weaving without stored threads.
Figure 13:
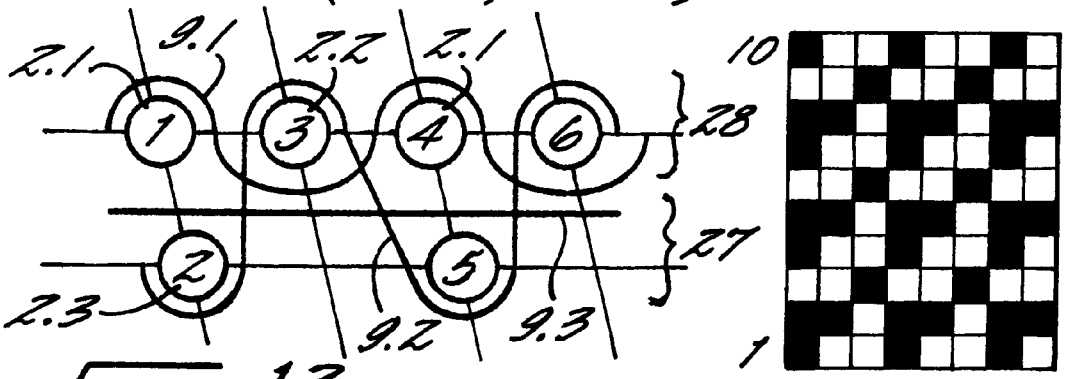
FIG. 13 shows a cross section and weave design of a two-layered fabric with an additional thread between every second weft and warp thread.
Figure 14:
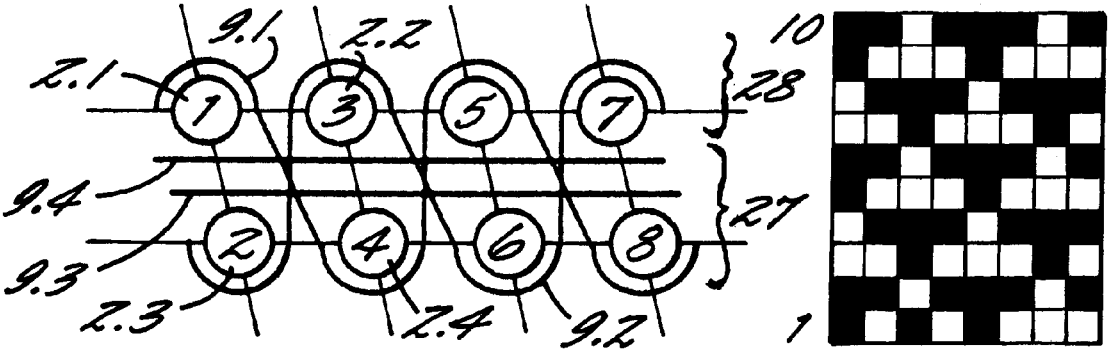
FIG. 14 shows a cross section and weave design of a two-layered fabric with an additional thread for each weft and warp thread.

FIGS. 12 to 14 present, with reference to three exemplary weave structures, how three-dimensional shell geometries are built up, filled up and adjusted in their structure and density with the aid of multi-layered weaves.

FIG. 12 shows a single-layered linen weave. No threads are "stored" therein.

The weave according to FIG. 13 contains, in a second plane 27, an "additional weft thread" 9.3 between each second weft thread and an "additional warp thread" 2.3 between each second warp thread 2.2. The "additional threads" are inserted in the upper layer to form the 3D shape.

In the weave according to FIG. 14, an "additional weft thread" 9.3 and 9.4 for each weft thread 9.1 and 9.2 and an "additional warp thread" 2.3 and 2.4 for each warp thread 2.1 and 2.2 are inserted as a second fabric layer 27.

Depending on how large the bulge is supposed to be, more or less threads from the additional layer 27 have to be tied up in the thread layer 28 which is to cause the bulge.

Depending on how large the eventually intended bulge of the three-dimensional fabric layer 28 is supposed to be, more or less threads have to be taken along in the additional layers 27 until being inserted into the bulged layer 28.

Figure 15:
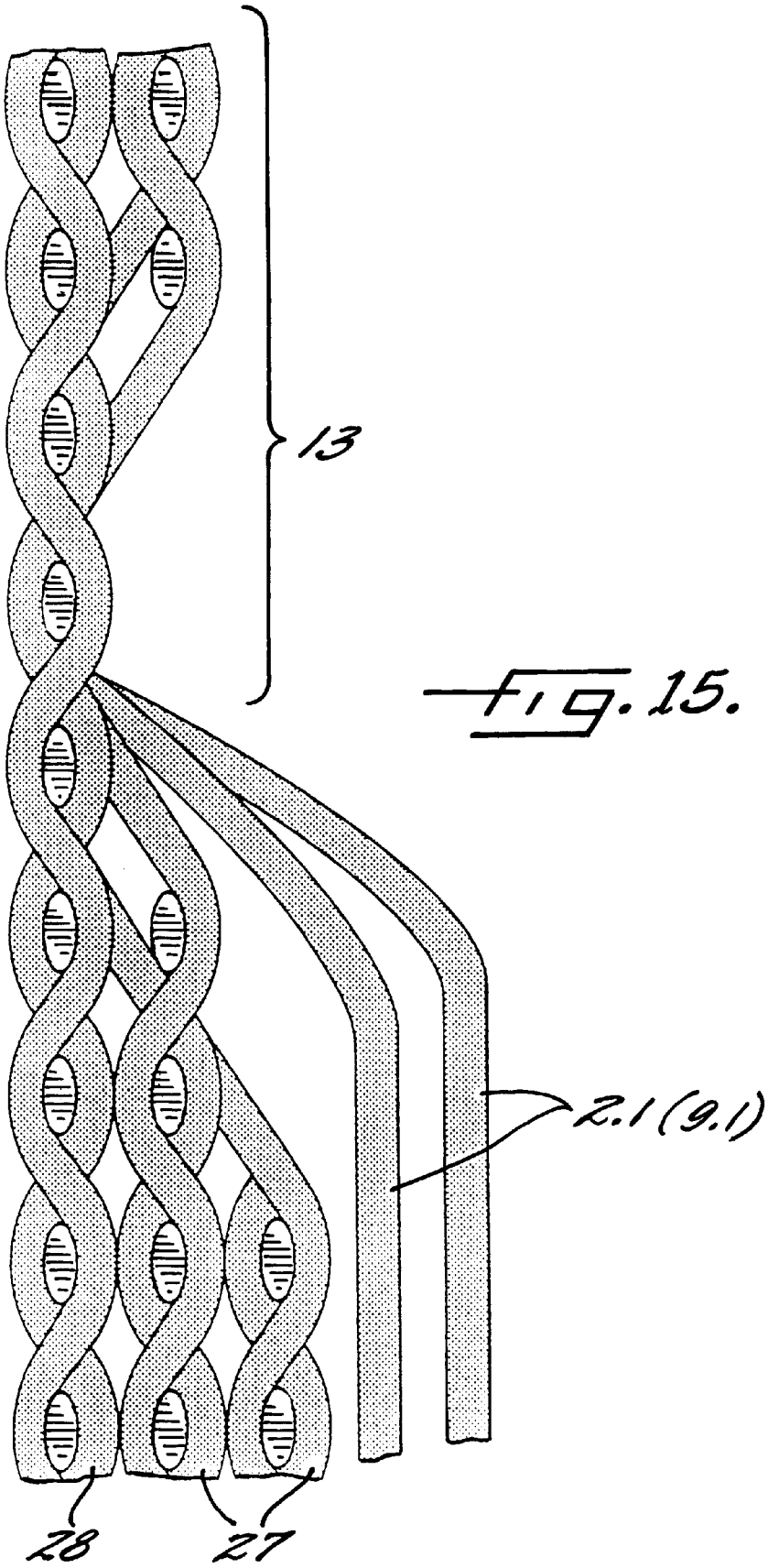
FIG. 15 shows a cross section through a weave with floating threads, FIG. 16 (*a*)–(*c*) shows a woven hemisphere.

In FIG. 15 there are also shown, apart from the formation of multiple additional layers 27, floating, non-interlaced threads (warp threads 2.1 or weft threads 9.1) being tied up across desired distances, i. e. fabric zone 13, into the plane/layer to be bulged.

Figures 16, 16A, 16B:
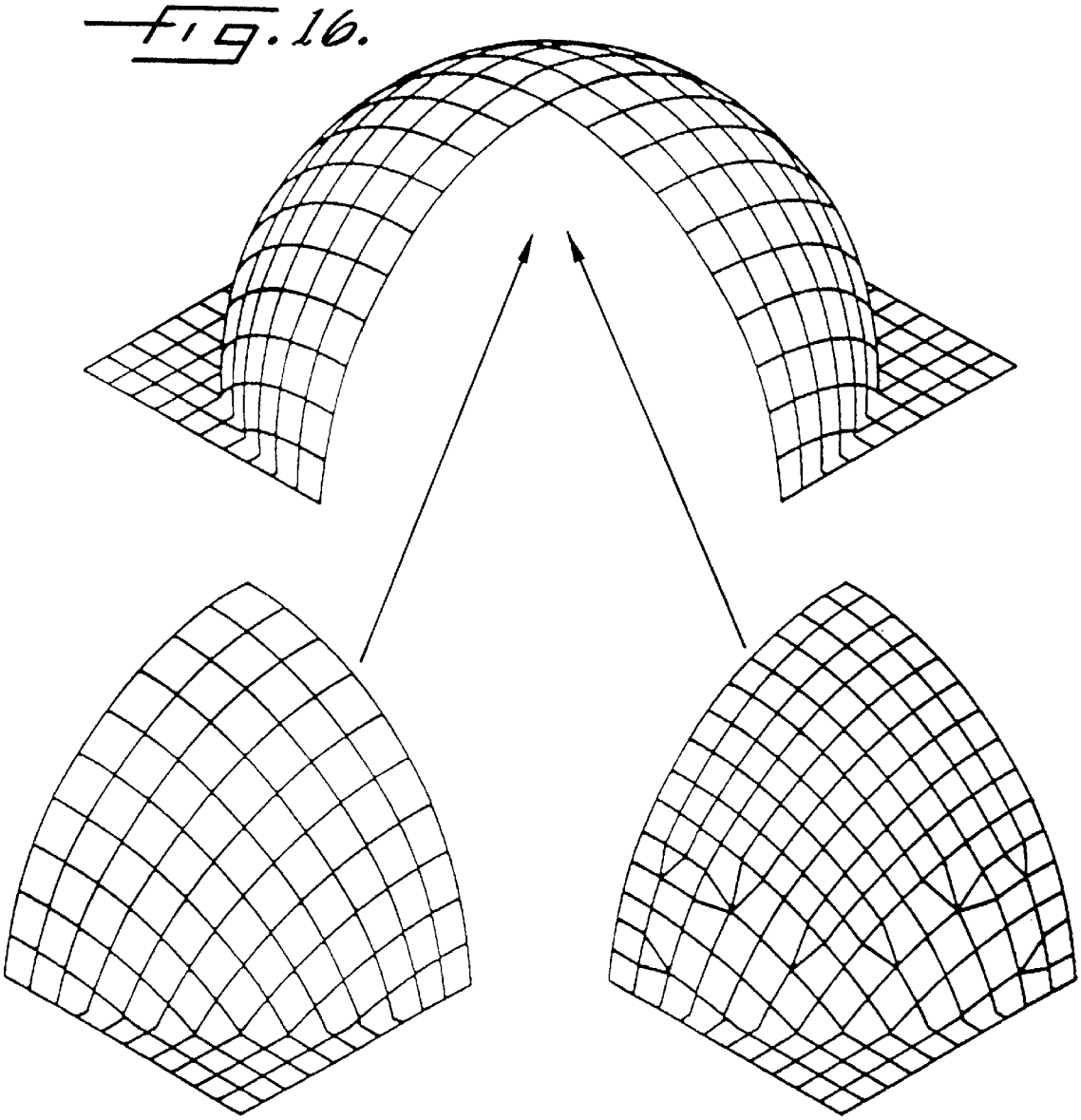

FIG. 16(*a*) shows the structure of a woven hemisphere.

FIG. 16(*b*) (left side) shows a fabric cutout according to the state of the art, in which no technical weaving process has been employed to balance increased distances between points of intersection or to adjust certain fabric properties, i. e.: only the distances of the points of intersection have been changed; in the area of the 3D shape, the fabric becomes less dense or netlike.

FIG. 16(*c*) (right side) shows a fabric cutout in which additional threads have been tied up in the surface. The density of the fabric does not depend on the 3D shape. In such a design, the fabric is usable, for example, as a breast area or a breast support for ladies' wear, as a container, as fiber reinforcement for a plastic component, e. g. a helmet shell.

Figure 17:
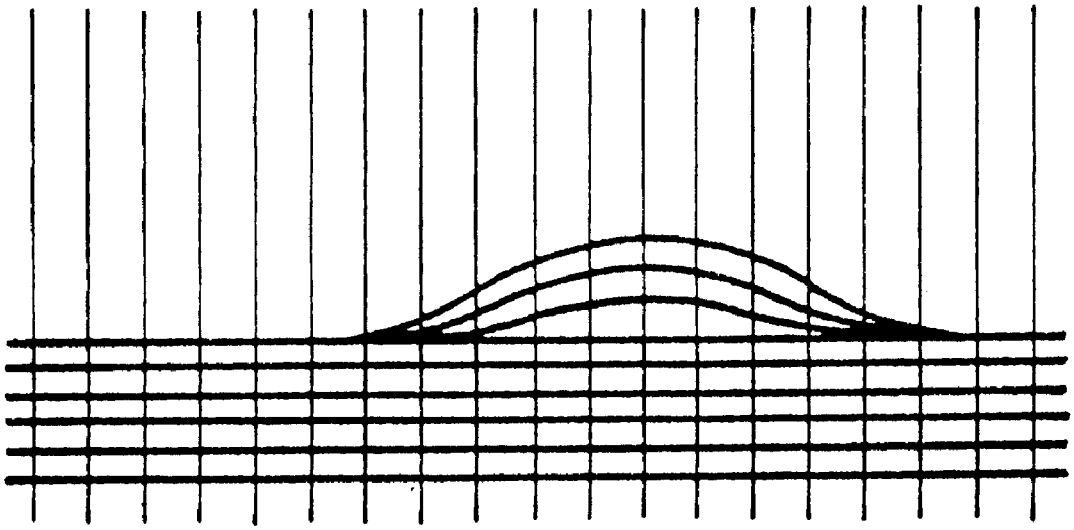
FIG. 17 shows the formation of a preliminary fabric.

With the example of weft threads 9 tied up additionally, FIG. 17 shows the formation of the preliminary fabric. It is based on the fact that a fabric surplus is produced in the three-dimensional fabric zone by reducing the distances between the weft threads and increasing the density of the fabric. A drawing-off process which produces different draw-off speeds across the width of the fabric is advantageous in this context, as the formation of the preliminary fabric can be balanced primarily by this process.

Figure 18:
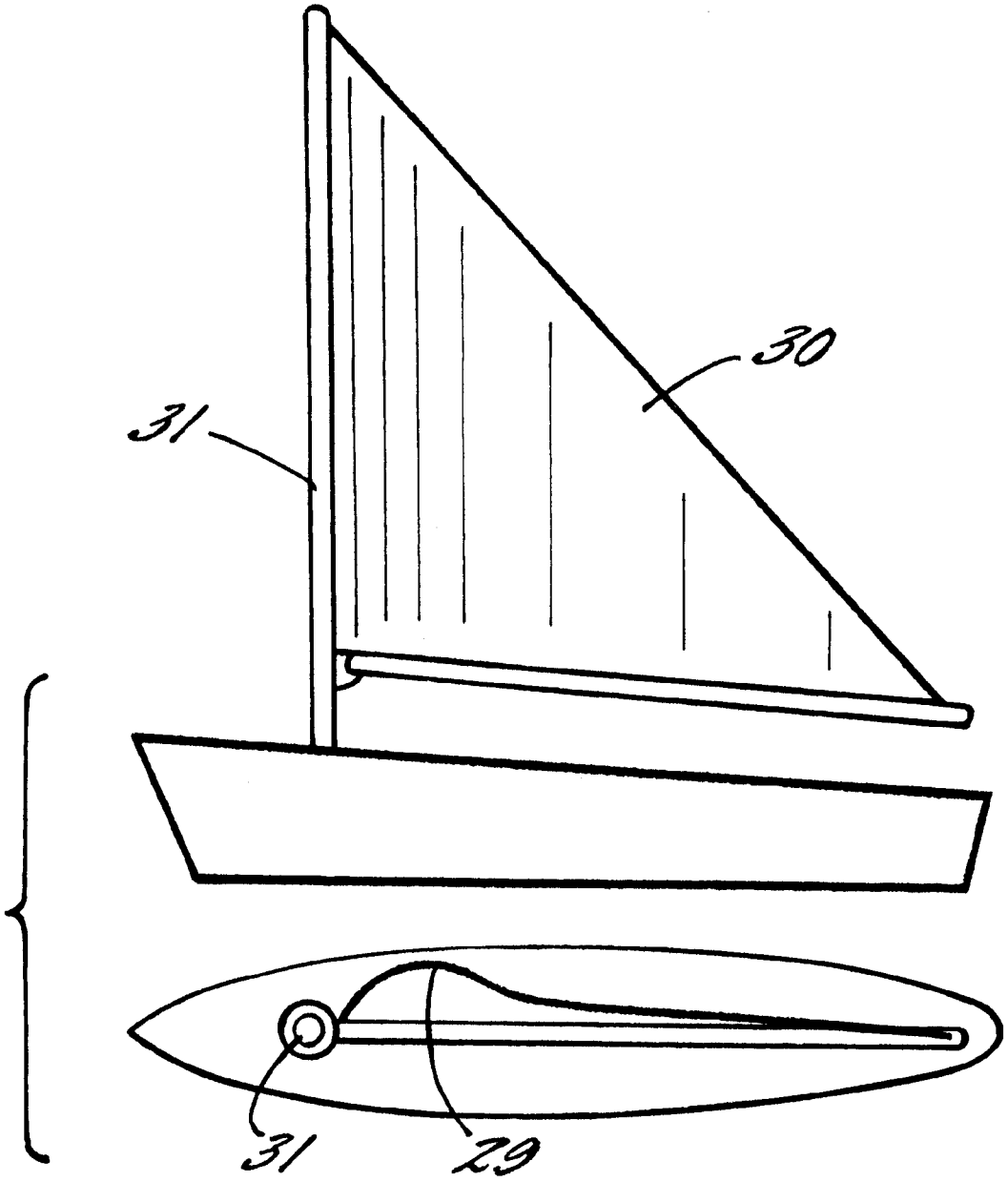
FIG. 18 shows a sail.

FIG. 18 shows a top view of a sailboat with a sail 30. On the side turned away from the wind, the sail bulges in the shape of the airfoil of an aircraft. This bulge 29 of the sail in the area of the mast 31 is a 3D shape formed according to this invention and produced without seams and subsequent deformations.

Figure 19:
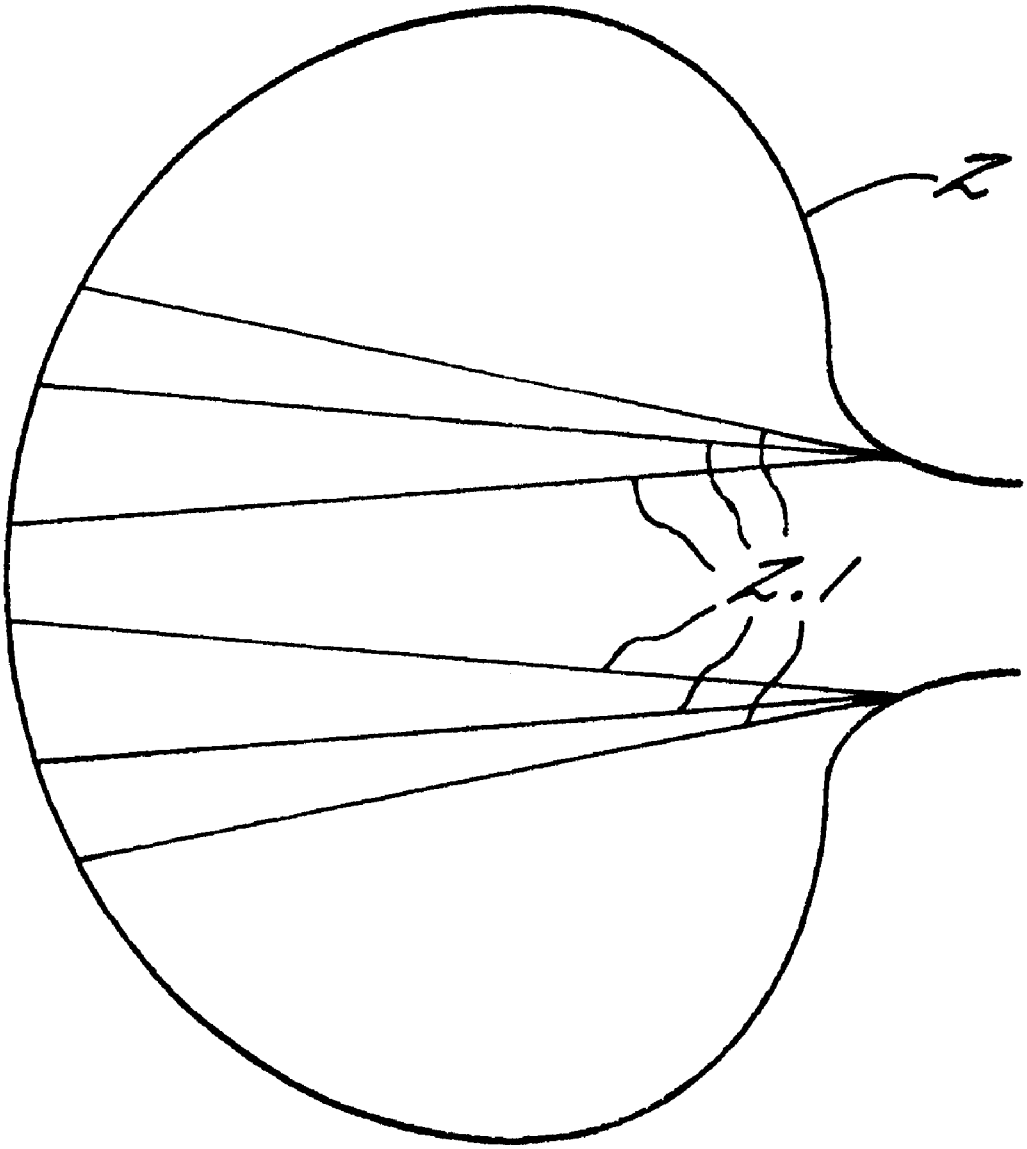
FIG. 19 shows a bag-like fabric.

FIG. 19 shows the cross section along a warp thread through a three-dimensional fabric in the shape of a bag. Such a bag can, for example, serve as an air bag or as a mold filled with gaseous, liquid, foaming, solid or loose material. The bag-like bulge is produced by a correspondingly narrow weaving structure and by tieing up a lot of additional weft and warp threads, respectively. Some warp threads 2.1, however, are not tied up in the area of the largest bulge. Instead, these warp threads float at a relatively high thread tension. These floating warp threads thus form a limit to the movement for the air bag and predetermine the shape in the inflated state.

I claim:

1. A process of weaving a fabric with a three dimensional bulging zone comprising the steps of interweaving warp and weft threads to form a fabric and including forming crossing points where the warp threads change from one side of the weft threads to the other side, increasing the density of the crossing points by changing the number of threads and/or changing the weave pattern so as to naturally impart a bulging zone in the fabric, and producing different draw-off speeds among selected warp threads so as to increase the length of the selected warp threads within the bulging zone and changing the separation distance between adjacent warp threads within the bulging zone.

2. The process as defined in claim 1 wherein the step of increasing the density of the crossing points includes changing the number of threads by floating a plurality of threads in the fabric outside the bulging zone while interweaving such threads in the bulging zone.

3. The process as defined in claim 1 wherein the step of increasing the density of the crossing points includes providing a multiple layer fabric and transporting threads from one fabric layer into the other fabric layer at the bulging zone.

4. The process as defined in claim 1 wherein the step of increasing the density of the crossing points includes changing the weave pattern and changing the number of threads in the bulging zone.

5. The process as defined in claim 1 wherein the interweaving step includes forming a fabric comprising two layers so as to form a hollow space at the bulging zone.

6. The process as defined in claim 5 wherein the hollow space is filled with a liquid, or a liquid foaming composition, or a solid material.

7. The process as defined in claim 1 wherein the interweaving step includes forming an area of the fabric surrounding the bulging zone so as to be two dimensional.

8. The process as defined in claim 1 wherein the bulging zone has the shape of a partial sphere or hemisphere.

9. The process as defined in claim 1 wherein the warp and/or weft threads include threads of a first material and threads of a second material, with the second material being settable by thermal or chemical treatment, and comprising the further step of subjecting the bulging zone to a thermal or chemical treatment so as to set the second material and thereby form a continuous three dimensional rigid matrix which includes the threads of the first material.

10. The process as defined in claim 1 wherein at least one of the interwoven threads is coated and/or soaked with a curable liquid plastic, and comprising the further step of shaping the bulging zone into a desired configuration and then curing the plastic.

11. A process of weaving a fabric with a three dimensional bulging zone comprising the steps of interweaving warp and weft threads to form a fabric and including forming crossing points where the warp threads change from one side of the weft threads to the other side, while increasing the density of the crossing points so as to naturally impart a bulging zone in the fabric and including changing draw-off speeds among selected warp threads so as to increase the length of the selected warp threads within the bulging zone, while increasing the separation distance between adjacent warp threads within the bulging zone, and while changing the weave pattern in the bulging zone.

12. An apparatus adapted for weaving a fabric having a three dimensional bulging zone therein and comprising a creel adated to support a plurality of warp thread bobbins, a draw-off mechanism for individually drawing off selected lengths of warp threads from the warp bobbins, a jacquard head for raising and lowering the warp threads to form the weaving sheds in which weft threads may be laid, said jacquard head having a control for changing the number of threads woven and/or the weave pattern so as to permit a bulging zone to be formed in the fabric.

13. The weaving apparatus as defined in claim 12 further comprising a reed positioned downstream of said jacquard head and mounted for movement between a retracted position and a beat-up position, said reed having a plurality of laterally spaced apart dents arranged in a generally vertical direction so that the warp threads can be fed respectively between adjacent dents and wherein the reed is configured such that the lateral spacing of the dents can be changed with respect to the warp threads passing therethrough.

14. The weaving apparatus as defined in claim 13 wherein the jacquard head includes eyelets for receiving individual warp threads, and wherein the apparatus further comprises guide means for laterally moving the eyelets in cooperation with the changing of the lateral spacing of the dents, so that the warp threads pass through their respective eyelets and an adjacent pair of dents without the direction of the warp threads being substantially changed irrespective of the lateral spacing of the dents.

15. The weaving apparatus as defined in claim 14 wherein the dents are fixedly mounted with respect to each other in a generally vertical fan-like arrangement, and wherein the reed is moveable up and down to change the lateral separation of the dents with respect to the warp threads, and further comprising means for selectively moving the reed up and down.

16. The weaving apparatus as defined in claim 14 wherein said draw-off mechanism includes a draw-off beam which is separated into separately driveable conveying segments for conveying individual warp threads or groups of warp threads at individually controlled speeds.

17. The weaving apparatus as defined in claim 16 wherein said draw-off mechanism further includes a brake associated with each warp thread, and a brake control for individually controlling each of the brakes.

18. A fabric comprising interwoven warp and weft threads which define crossing points where the warp threads change from one side of the weft threads to the other side, and wherein the fabric has a density of the crossing points and/or a weave pattern which naturally imparts a three dimensional bulging zone in the fabric, wherein the fabric further comprises lengths of the warp yarns in the bulging zone which contribute to the bulging zone in the fabric, and wherein selected ones of the warp and weft threads include a thermally or chemically set material, to thereby form a continuous three dimensional rigid matrix in the bulging zone which is reinforced by the remaining threads.

19. A process of weaving a fabric with a three dimensional bulging zone comprising the steps of interweaving warp and weft threads to form a fabric and including forming crossing points where the warp threads change from one side of the weft threads to the other side, increasing the density of the crossing points by changing the number of threads and/or changing the weave pattern so as to naturally impart a bulging zone in the fabric, wherein the interweaving step includes forming a fabric comprising two layers so as to form a hollow space at the bulging zone, and wherein the hollow space is filled with a liquid, or a liquid foaming composition, or a solid material.

20. A process of weaving a fabric with a three dimensional bulging zone comprising the steps of interweaving warp and weft threads to form a fabric and including forming crossing points where the warp threads change from one side of the weft threads to the other side, increasing the density of the crossing points by changing the number of threads and/or changing the weave pattern so as to naturally impart a bulging zone in the fabric, and wherein at least one of the interwoven threads is coated and/or soaked with a curable liquid plastic, and comprising the further step of shaping the bulging zone into a desired configuration and then curing the plastic.

* * * * *